US009437926B2

(12) United States Patent
Azad et al.

(10) Patent No.: US 9,437,926 B2
(45) Date of Patent: Sep. 6, 2016

(54) ANTENNA HAVING ASYMMETRIC T SHAPE COUPLED FEED

(71) Applicant: Wistron Corporation, New Taipei (TW)

(72) Inventors: Mohammed Ziaul Azad, Rolling Meadows, IL (US); Firass Badaruzzaman, Rolling Meadows, IL (US); Hou-Chun Huang, New Taipei (TW)

(73) Assignee: Wistron Corporation, New Taipei (TW)

( * ) Notice: Subject to any disclaimer, the term of this patent is extended or adjusted under 35 U.S.C. 154(b) by 50 days.

(21) Appl. No.: 14/557,016

(22) Filed: Dec. 1, 2014

(65) Prior Publication Data

US 2016/0156102 A1 Jun. 2, 2016

(51) Int. Cl.

| | |
|---|---|
| ***H01Q 1/24*** | (2006.01) |
| ***H01Q 5/378*** | (2015.01) |
| ***H01Q 1/50*** | (2006.01) |
| ***H01Q 9/04*** | (2006.01) |

(52) U.S. Cl.

CPC ..... *H01Q 5/378* (2015.01); *H01Q 1/50* (2013.01); *H01Q 9/04* (2013.01)

(58) Field of Classification Search

CPC ..... H01Q 1/243; H01Q 1/38; H01Q 1/50; H01Q 9/0457; H01Q 5/378

See application file for complete search history.

(56) References Cited

U.S. PATENT DOCUMENTS

| | | | | |
|---|---|---|---|---|
| 7,136,019 | B2 * | 11/2006 | Mikkola | H01Q 1/243 343/700 MS |
| 8,618,988 | B2 * | 12/2013 | Fabrega-Sanchez | H01Q 1/243 343/702 |
| 2001/0050643 | A1 * | 12/2001 | Egorov | H01Q 1/243 343/702 |
| 2014/0361948 | A1 * | 12/2014 | Tanaka | H01Q 1/38 343/861 |

FOREIGN PATENT DOCUMENTS

| | | | |
|---|---|---|---|
| TW | 200905987 | A | 2/2009 |

* cited by examiner

*Primary Examiner* — Hoang V Nguyen
(74) *Attorney, Agent, or Firm* — Leydig, Voit & Mayer, Ltd.

(57) ABSTRACT

A broadband antenna for interfacing an electronic device with a plurality of radio access technologies is provided. The antenna includes an excitation element and a parasitic element. The excitation element includes a feed line with a first distal end and a second distal end with first and second arms extending from the second distal end, wherein one of the first or second arms is shorter than the other such that the excitation element forms an asymmetrical T shape. The length of the first and second arms determines at least two modes of operation of the antenna. The parasitic element wraps around the asymmetrical T shape and includes a length configured to provide another mode of operation of the antenna.

25 Claims, 5 Drawing Sheets

ANTENNA HAVING ASYMMETRIC T SHAPE COUPLED FEED

FIELD OF THE INVENTION

This invention generally relates to an antenna for mobile devices, and more particularly to a broadband antenna capable of operating over relevant frequency bandwidths for a plurality of radio access technologies.

BACKGROUND OF THE INVENTION

As mobile voice and data demands increase, demand for wireless mobile devices that can operate over a plurality of radio access technology increases. The various radio access technologies operate over a range of frequencies in the electromagnetic spectrum. In order for a mobile device to interface with voice and data networks over these various radio access technologies, the mobile device will need to be equipped with an antenna configured to operate over the relevant bandwidth for that radio access technology. Typically, this requires having multiple antenna Stock Keeping Units (SKUs) with each SKU directed to providing access to a subset of the total bandwidth required to communicate effectively over the plurality of radio access technologies.

Additionally, as demand for voice and data services increases, so does the demand for mobile devices to have greater processing power and support a greater number of user features. This demand persists even in contrast to a drive for thinner mobile devices that contain less internal physical space in which to house the processors, memory and various other electrical and mechanical structures required to meet the demand for greater processing power and greater number of user features.

In this regard, less physical space within the mobile devices can be utilized for an antenna(s) to allow the mobile device to operate over various radio access technologies. Accordingly, a need exists for a single broadband antenna design capable of operating over frequencies relevant to a plurality of radio access technologies.

BRIEF SUMMARY OF THE INVENTION

One embodiment provides an antenna. The antenna includes an excitation element configured for coupling to an antenna feed carrying an excitation signal produced by a signal source; and a grounded parasitic element including a parasitic element length. Wherein the excitation element includes: a feed line with a first distal end and a second distal end separated by a feed line length; a first arm including a first arm length, wherein the first arm length extends from the second distal end in a first direction from the feed line length; and a second arm including a second arm length, wherein the second arm length extends from the second distal end in a second direction from the excitation element length. And wherein the parasitic element length is at least partially coextensive with the excitation element, such that a first gap including a first gap separation distance is formed between the parasitic element and the first arm and a second gap including a second gap separation distance is formed between the parasitic element and the second arm.

Another embodiment provides an electronic device having a broadband antenna and capable of wireless transmissions. The electronic device including a wireless signal module and an antenna electrically connected to the wireless signal module. The antenna includes an excitation element configured for coupling to an antenna feed carrying an excitation signal produced by a signal source and a parasitic element including a parasitic element length. Wherein the excitation element includes: a feed line with a first distal end and a second distal end separated by a feed line length; a first arm including a first arm length, wherein the first arm length extends from the second distal end in a first direction from the feed line; and a second arm including a second arm length, wherein the second arm length extends from the second distal end in a second direction from the feed line. And wherein the parasitic element length is at least partially coextensive with the excitation element such that a first gap including a first gap separation distance is formed between the parasitic element and the first arm and a second gap including a second gap separation distance is formed between the parasitic element and the second arm.

Yet another embodiment provides a broadband antenna. The broadband antenna including an excitation element configured for coupling to an antenna feed carrying an excitation signal produced by a signal source and a parasitic element including a parasitic element length. Wherein the excitation element includes: a feed line with a first distal end and a second distal end separated by an excitation element length; a first arm including a first arm length, wherein the first arm length extends from the second distal end in a first direction from the excitation element length; a second arm including a first end and a second end with a second arm length spanning the distance between the first end and the second end, the first end of the second arm is attached to the second distal end of the excitation element, wherein the second arm length extends from the second distal end in a second direction from the excitation element length; and a second arm extension connected to the second end of the second arm. Wherein the second arm extension includes a second arm extension length that extends perpendicular to the second arm length. And wherein the parasitic element length is at least partially coextensive with the excitation element.

BRIEF DESCRIPTION OF THE SEVERAL VIEWS OF THE DRAWING(S)

The accompanying drawings incorporated in and forming a part of the specification illustrate several aspects of the present invention and, together with the description, serve to explain the principles of the invention. In the drawings.

DETAILED DESCRIPTION OF THE INVENTION

Figure 1:
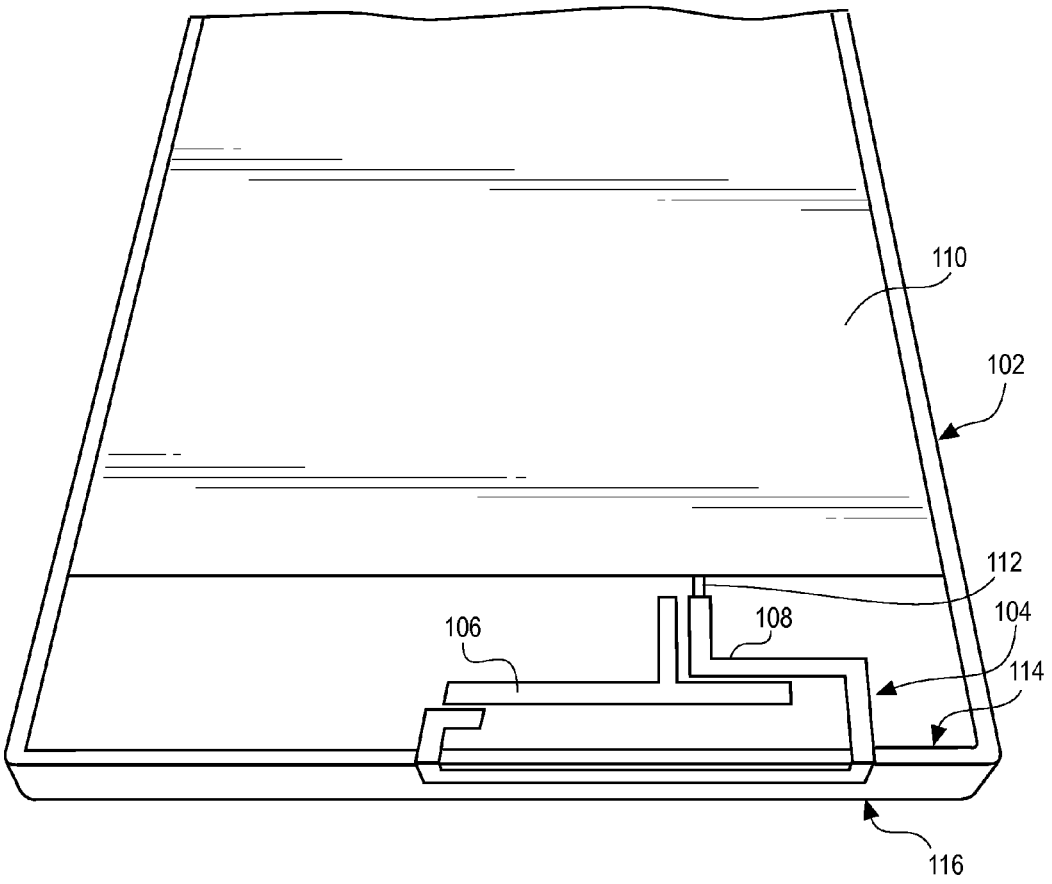
FIG. 1 is a view of an antenna arranged relative to a mobile device, according to an exemplary embodiment.

FIG. 1 illustrates an exemplary embodiment of a substrate 102 supporting an antenna 104. The antenna 104 may be defined as a combination of antenna elements 106, 108 and a ground structure 110. The substrate 102 can be represented by a rigid printed circuit board (PCB) constructed with a common compound such as FR-4, or a flexible PCB made of a compound such as Kapton™ (trademark of DuPont). The substrate 102 can comprise a multi-layer PCB having one layer as the ground structure 110 (or portions of the ground structure 110 dispersed in multiple layers of the PCB). The ground structure 110 can be planar, or a curved surface in the case of a flexible PCB. For convenience, the ground structure 110 will be referred to herein as a ground plane without limiting the possibility that the ground structure can be curved or formed by several inter-coupled conducting sections that do not necessarily belong to the same or any substrate. The PCB can support components making up portions of a transceiver and controller (see wireless signal module 1002 of FIG. 10). Suitable ground structures may be constructed from multiple inter-coupled layers or inter-coupled sections as well (for instance, clam shell or slider phones have ground structures that are realized by suitable interconnection of various sub-structures). In certain embodiments, the extremities of the ground structure 110 form an approximately rectangular shape having a length dimension and a width dimension, which may be average dimensions. In some phone designs, such as a clam shell or slider phone, the length of the ground plane may change as the orientation of phone parts is changed. The shape may be approximately rectangular in that it may be, for example tapered or trapezoidal to fit a housing, and as mentioned above, may be curved to conform to a housing, and the edges may not be straight or smooth—for example when an edge of the ground plane has to bypass a feature of a housing such as a plastic mating pin or post.

In the illustrated embodiment, the antenna 104 includes an excitation element 106 and a parasitic element 108. The excitation element 106 is connected to a wireless signal module 1002 (see FIG. 10), at feed point F. The wireless signal module 1002 (see FIG. 10) is configured to function as a signal source that provides an excitation signal to the excitation element 106 at feed point F. The parasitic element 108 is attached to the ground plane 110 at ground conductor 112. The parasitic element 108 is generally configured to resonate at a lower frequency than the excitation element 106 and thereby increase a useable bandwidth of the antenna 104.

Figure 2:
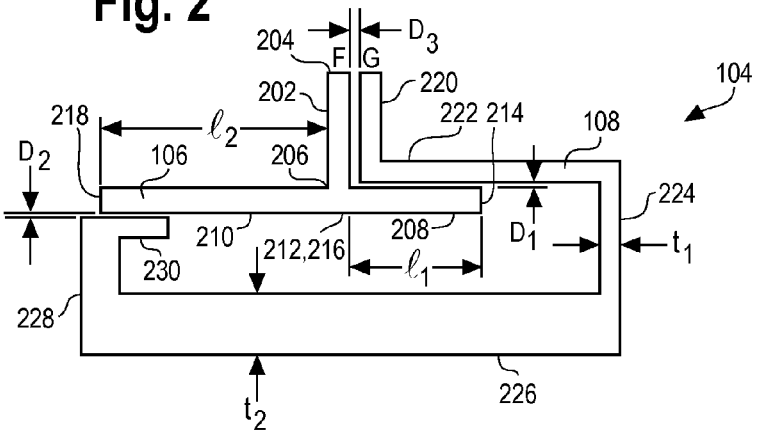
FIG. 2 is a view of the antenna of FIG. 1, according to an exemplary embodiment.

FIG. 2 illustrates an up-close view of the antenna 104, according to an example embodiment. As discussed above, the antenna 104 includes the excitation element 106 and the parasitic element 108. The excitation element 106 further includes a feed line 202 with a first distal end 204 and a second distal end 206 separated by a feed line length. The feed point F is at the first distal end 204. The excitation element 106 further includes a first arm 208 and a second arm 210. The first arm 208 includes a first end 212 and a second end 214 and a first arm length $l_1$ spanning the distance between the first end 212 and the second end 214. The first arm 208 is arranged such that it is attached to the second distal end 206 of the feed line 202 at the first end 212. The first arm 208 extends away from second distal end 206 in a first direction. In the illustrated embodiment, the first direction is away from the second distal end 206 in a line perpendicular to the feed line 202.

The second arm 210 includes a first end 216 and a second end 218 and a second arm length $l_2$ spanning the distance between the first end 216 and the second end 218. In the illustrated embodiment, the first end 216 of the second arm 210 is at substantially the same position as the first end 212 of the first arm 208. The second arm 210 is arranged such that it is attached to the second distal end 206 of the feed line 202 at the first end 216. The second arm 210 extends away from second distal end 206 in a second direction different from the first direction of the first arm 208. In the illustrated embodiment, the second direction is away from the second distal end 206 in a line perpendicular to the feed line 202 and opposite from the first direction of the first arm 208. As illustrated in FIG. 2, the excitation element forms an asymmetric T shape.

The antenna 104 also includes the parasitic element 108, which wraps around the excitation element 106 and is connected to the ground plane 110 (see FIG. 1) at the ground conductor 112. In the illustrated embodiment, the parasitic element 108 includes a first portion 220, a second portion 222, a third portion 224, a fourth portion 226, a fifth portion 228 and a sixth portion 230.

As an aside, it should be appreciated that the length of the first portion 220 and the length of the feed line 202 need not be the same. Further, it should be appreciated that every element of the antenna 104 does not have to lie in the same plane. For instance, as illustrated in FIG. 1, a portion of the antenna 104 may lay in a first plane 114 and another portion of the antenna 104 may lie in a second plane 116, where the first and second planes are perpendicular to one another.

The parasitic element 108 is at least partially aligned or coextensive with the excitation element 106. In the illustrated embodiment, the first portion 220 of the parasitic element 108 is at least partially coextensive with the feed line 202 of the excitation element 106; the second portion 222 of the parasitic element 108 is at least partially coextensive with the first arm 208 of the excitation element 106; and the sixth portion 230 of the parasitic element 108 is at least partially coextensive with the second arm 210 of the excitation element 106. Additionally, in certain embodiments, the third portion 224 is substantially perpendicular to the second portion 222, the fourth portion 226 is substantially perpendicular to the third portion 224 and the fifth portion 228 is substantially perpendicular to both the fourth portion 226 and the sixth portion 230.

As used herein, coextensive means at least two antenna arm lengths running side by side in a substantially parallel manner for at least a portion of each of the lengths of the two antenna arms. Further, the descriptions "substantially aligned," "substantially coextensive" or "substantially parallel," mean that, in some embodiments, the ratio of the closest separation (gap) and largest separation (gap) between the centerlines of the elongated conductors, arms, portions, or antenna elements may be up to 1.5:1. In some embodiments this gap variation ratio may be substantially less, such as 1.2:1, or less than 1.05:1.

In the illustrated embodiment, this coextensive arrangement between the excitation element 106 and the parasitic element 108 creates three gaps each with a gap separation distance between the relevant portions of the excitation element 106 and the parasitic element 108. As illustrated, a first gap with a first gap separation distance $D_1$ is formed between the first arm 208 of the excitation element 106 and the second portion 222 of the parasitic element 108. A second gap with a second gap separation distance $D_2$ is formed between the second arm 210 of the excitation element 106 and the sixth portion 230 of the parasitic element 108. And a third gap with a third gap separation distance $D_3$ is formed between the feed line 202 of the excitation element 106 and the first portion 220 of the parasitic element 108. Each gap separation distance $D_1$, $D_2$ and $D_3$ may range from approximately 0.1-1.0 mm.

The antenna 104 is generally configured to cover multiple bandwidths relevant to a plurality of radio access technologies. More specifically, in the illustrated embodiment, the antenna 104 is configured to have resonance at the low bands covering the frequency range of 704-960 MHz, which are relevant to the Global System for Mobile Communications (GSM), the Universal Mobile Telecommunications System (UMTS) and Long Term Evolution (LTE) radio access technologies. The antenna 104 is further configured to have resonance at Global Positioning System (GPS) or Global Navigation Satellite System (GLONASS) frequencies covering a bandwidth between 1575-1610 MHz. The antenna 104 is further configured to have resonance at the mid bands covering the frequency range of 1710-2170 MHz, which are relevant to GSM, UMTS and LTE radio access technologies. The antenna 104 is further configured to have resonance at WiFi and Bluetooth frequencies covering a bandwidth between 2400-2485 MHz. And the antenna 104 is further configured to have resonance at the high bands covering the frequency range of 2500-2700 MHz, which is relevant to the LTE radio access technology.

The resonance at the high bands is created by the length $l_1$ of the first arm 208 of the excitation element 106. The resonance at the mid bands is created by the length $l_2$ of the second arm 210 of the excitation element 106. And the resonance of the low bands is created by the total length of the parasitic arm 108. Accordingly, the length $l_1$ of the first arm 208 of the excitation element 106 ranges between 25-30 mm, the length $l_2$ of the second arm 210 of the excitation element 106 ranges between 34-44 mm and the total length of the parasitic arm 108 ranges between 78-106 mm. The ranges of lengths are determined based on calculating a quarter wavelength of the desired resonance frequency.

Further, the coupling between the first and second portions 220, 222 of the parasitic element 108 and the feed line 202 and the first arm 208 of the excitation element 106 extends the high band resonance bandwidth such that it also covers the WiFi and Bluetooth bandwidth from 2400-2485 MHz. And the coupling between the sixth portion 230 of the parasitic element 108 and the second arm 210 of the excitation element 106 extends the mid band resonance bandwidth such that it also covers the GPS and GLONASS bandwidth from 1575-1610 MHz. The degree of coupling between the above described elements is controlled by the distances $D_1$, $D_2$ and $D_3$ in that the smaller the distance, the greater the coupling between the relevant antenna elements.

Figure 3:
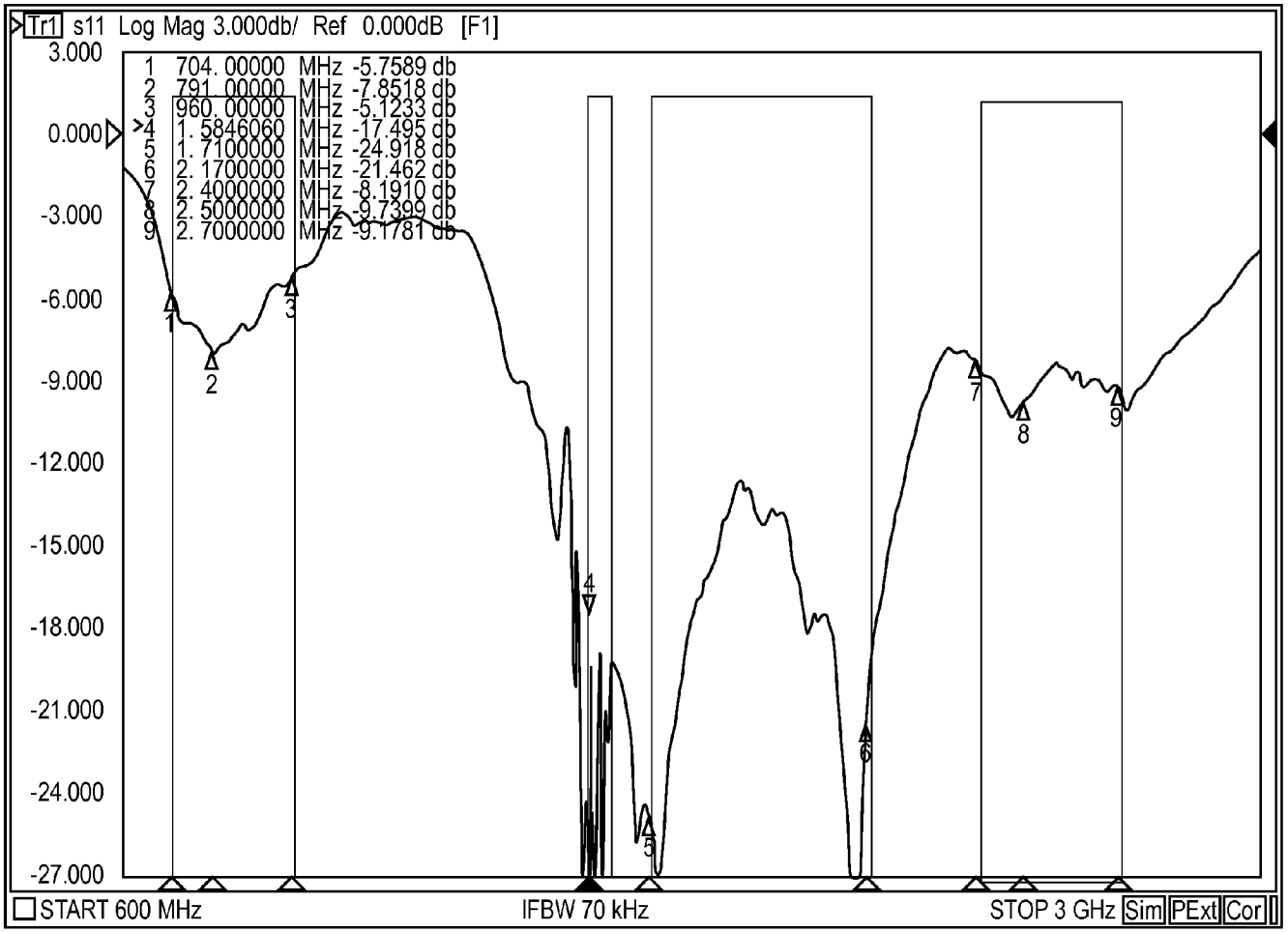
FIG. 3 is a plot of return loss for the antenna of FIG. 1, according to an exemplary embodiment.

FIG. 3 illustrates a plot of return loss of the antenna 104 over the relevant bandwidths for the low, mid, high, GPS/GLONASS and WiFi/Bluetooth frequencies. In the upper left corner of the plot of return loss, a legend is provided which illustrates markers 1 and 3, which are relevant for the low bands; 4, 5 and 6, which cover the GPS/GLONASS and mid bands; and 7 and 9, which cover the WiFi/Bluetooth and high bands. In general, an antenna with a return loss of less than −3 dB at a certain frequency would be considered to have resonance at that frequency. As can be seen in the legend, the highest value return loss for each of the above mentioned markers is −5.1233 dB. Accordingly, the antenna 104 is capable of supporting each of the previously mentioned radio access technologies within the relevant bandwidths for low, mid, high, GPS/GLONASS and WiFi/Bluetooth frequencies.

Figure 4:
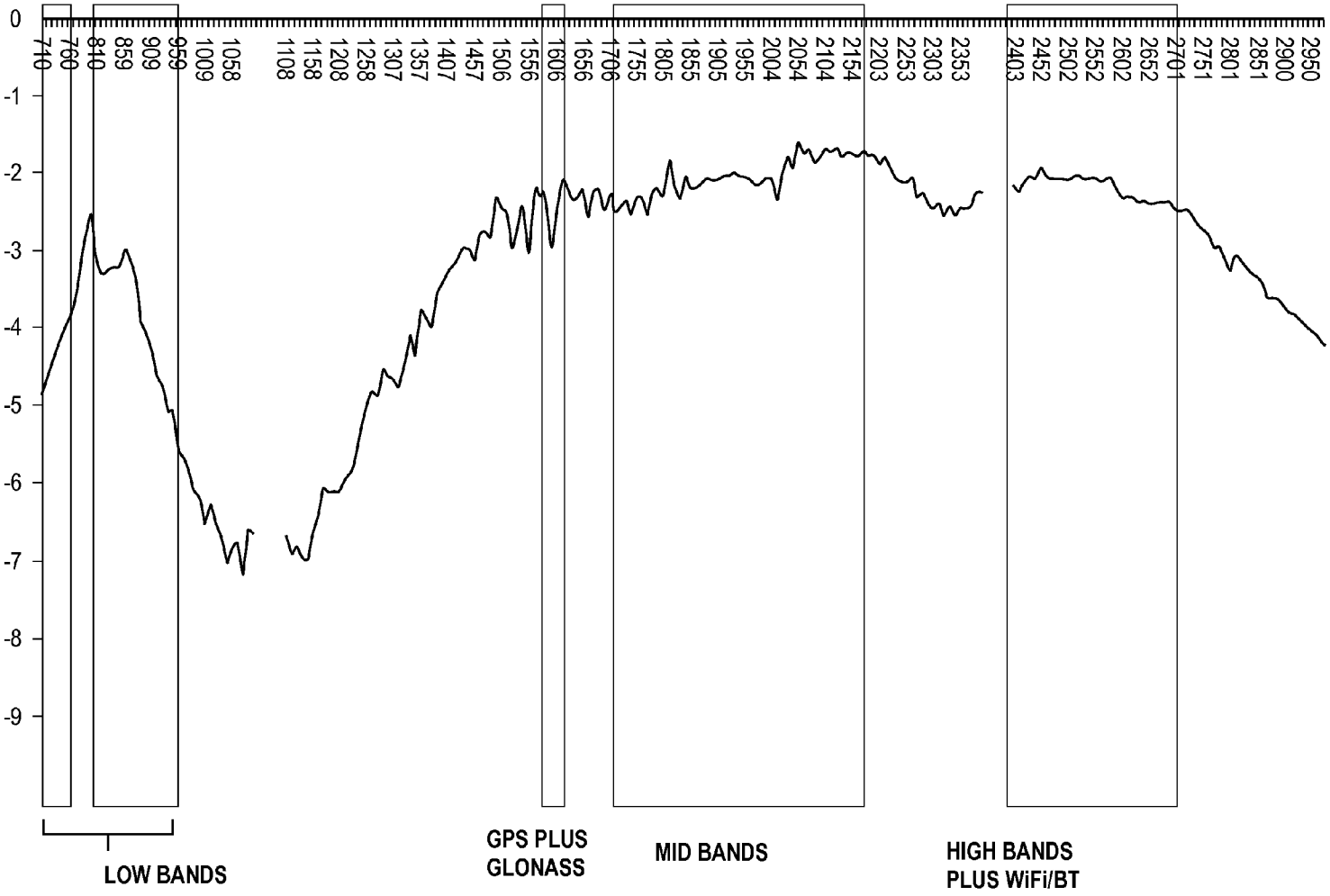
FIG. 4 is an efficiency plot for the antenna of FIG. 1, according to an exemplary embodiment.

FIG. 4 illustrates the efficiency of the antenna 104. The antenna 104 has good efficiency for the desired frequency bandwidths for the low, mid, high, GPS/GLONASS and WiFi/Bluetooth. As illustrated, the antenna 104 has a worst case efficiency of −5 dB and a best case of −2.5 dB in the low band; an efficiency of −2.2 dB in the GPS/GLONASS bandwidth; a worst case efficiency of −2.5 dB and a best case of −1.8 dB in the mid band; and a worst case efficiency of −2.5 dB and a best case of −2 dB in the high band and the WiFi/Bluetooth bandwidth.

As an aside, impedance matching may be required to tune the specific resonance and bandwidths illustrated in FIG. 3 and efficiency illustrated in FIG. 4. For instance, impedance matching between the wireless signal module 1002 (see FIG. 10) and the feed point F for the antenna 104 may be utilized to achieve the desired and improved bandwidth for the low band frequencies from 704-960 MHz, or any other bandwidth.

Figure 5:
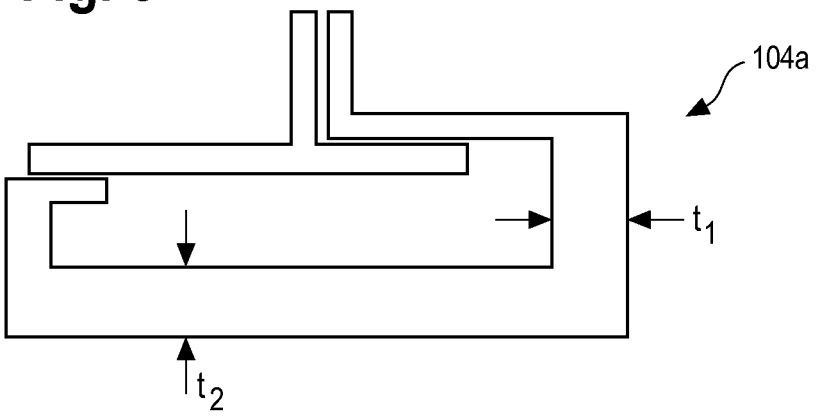
FIG. 5 is a view of an antenna according to a particular embodiment.
Figure 6:
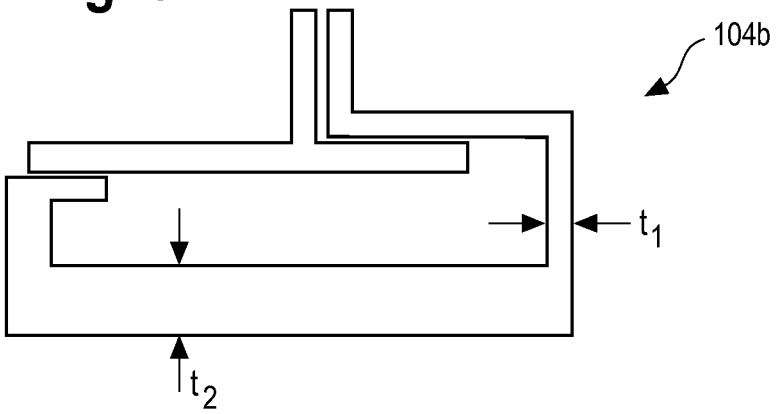
FIG. 6 is a view of an antenna according to a particular embodiment.
Figure 7:
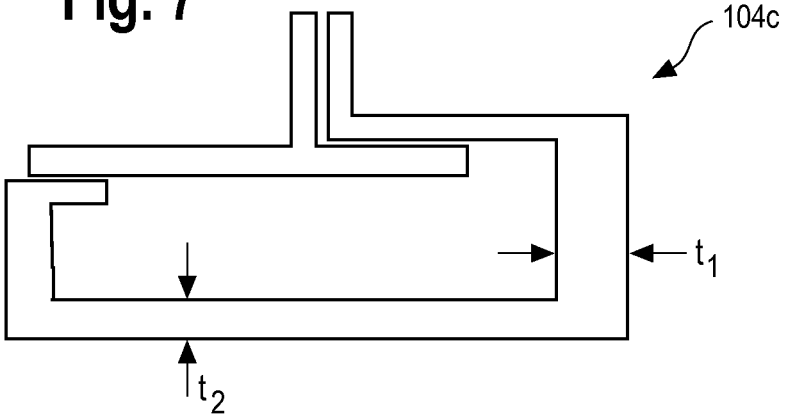
FIG. 7 is a view of an antenna according to a particular embodiment.

Returning briefly to FIG. 2, bandwidth in the low band covering 704-960 MHz can be further tuned by varying thicknesses $t_1$ and $t_2$. By varying these thicknesses either together or independently, the bandwidth of the low band can be tuned to cover the desired frequency bandwidth. FIGS. 5-7 illustrate embodiments where antennas 104*a*, 104*b* and 104*c* have varied thicknesses $t_1$ and $t_2$. The thicknesses $t_1$ can be between 1 and 10 mm, and the thickness $t_2$ can be between 1 and 10 mm.

Figure 8:
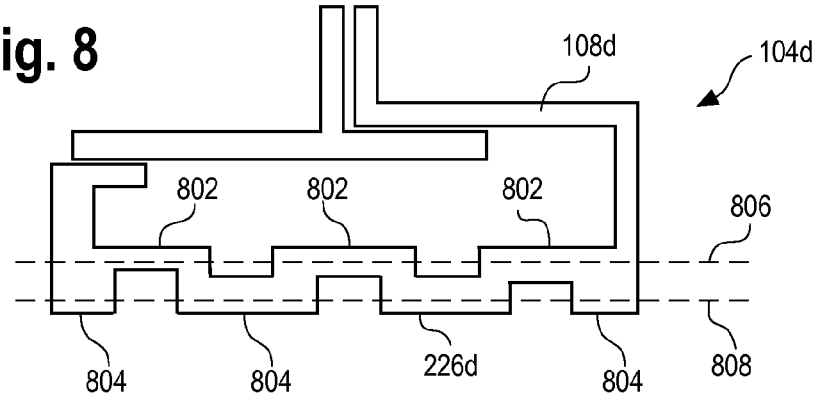
FIG. 8 is a view of an antenna according to a particular embodiment

FIG. 8 illustrates an embodiment of antenna 104*d* where the fourth portion 226*d* of parasitic element 108*d* is configured in a box car layout including a plurality of first sections 802 and a plurality of second sections 804. The plurality of first sections 802 and the plurality of second sections 804 are connected to form a single box car layout structure for the fourth portion 226*d*. Further, the plurality of first sections 802 are arranged along a first axis 806, and the plurality of second sections 804 are arranged along a second axis 808. In the illustrated embodiment, the first axis 806 and the second axis 808 are substantially parallel. This configuration increases the overall length of the parasitic element 108*d* and therefore is effective to tune the resonance of the low bands to cover lower frequencies.

Figure 9:
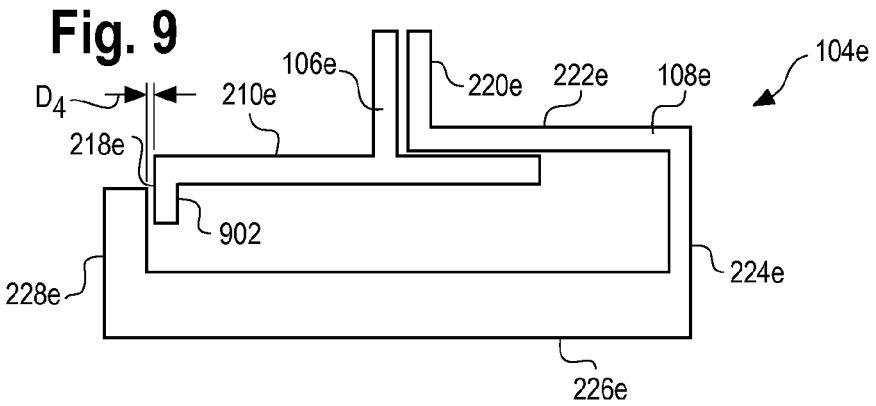
FIG. 9 is a view of an antenna according to a particular embodiment.

FIG. 9 illustrates an embodiment where the second arm 210*e* of the excitation element 106*e* of the antenna 104*e* includes a second arm extension 902. The second arm extension 902 is connected to the second end 218*e* of the second arm 210*e*. The second arm extension 902 includes a second arm extension length that extends perpendicular to the second arm 210*e*. The parasitic element 108*e* is at least partially coextensive with the second arm extension 902. The parasitic element 108*e* is composed of a first portion 220*e*, a second portion 222*e*, a third portion 224*e*, a fourth portion 226*e* and a fifth portion 228*e*. In this manner, the second arm extension 902 is at least partially coextensive with the fifth portion 228*e*. Further, a distance $D_4$ is created by the separation distance between the second arm extension 902 and the fifth portion 228*e* of the parasitic element 108*e*. This embodiment illustrates a longer second arm 210*e*, which would allow tuning the resonance for the mid band frequencies downward in frequency. Further, the coupling between the fifth portion 228*e* of the parasitic element 108*e* and the second arm extension 902 could be utilized to tune the desired bandwidth for the mid band. The coupling would be controlled by varying the distance $D_4$, where the smaller the distance $D_4$ the greater the coupling.

Figure 10:
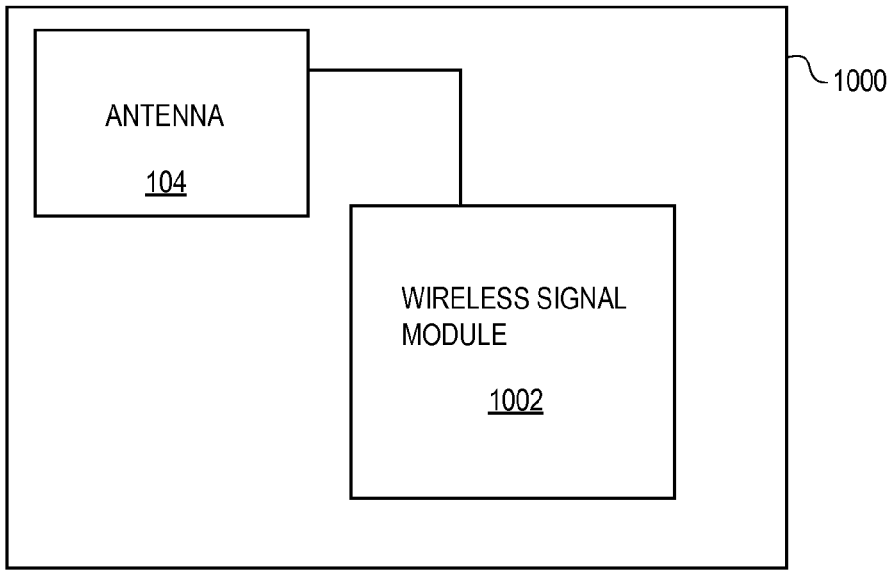
FIG. 10 is a block diagram of an electronic device including the antenna of FIG. 1, according to an exemplary embodiment.

FIG. 10 illustrates a block diagram of an electronic device 1000. The electronic device 1000 may be a cellular phone, a smart phone, a tablet computer, a laptop computer, a watch with a computer operating system, a personal digital assistant (PDA), a video game console, a wearable or embedded digital device(s), or any one of a number of additional devices capable of communicating over one or more radio access technologies. As illustrated, the electronic device 1000 includes a wireless signal module 1002 coupled to the antenna 104. The wireless signal module 1002 includes transceiver circuitry and a controller configured to process signals to transmit over the antenna 104 and process signals received from the antenna 104. The wireless signal module 1002 may be configured to communicate over any radio access technology. In certain embodiments, the wireless signal module 1002 may be configured to communicate over any one of or all of GSM, LTE, UMTS, GPS/GLONASS and/or WiFi/Bluetooth radio access technologies.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. An antenna, comprising:

an excitation element configured for coupling to an antenna feed carrying an excitation signal produced by a signal source; and a parasitic element including a ground connection and a parasitic element length, wherein the excitation element includes:

a feed line with a first distal end and a second distal end separated by a feed line length;

a first arm including a first arm length, wherein the first arm length extends from the second distal end in a first direction from the feed line length; and a second arm including a second arm length, wherein the second arm length extends from the second distal end in a second direction from the excitation element length; and wherein the parasitic element length is at least partially coextensive with the excitation element, such that a first gap including a first gap separation distance is formed between the parasitic element and the first arm and a second gap including a second gap separation distance is formed between the parasitic element and the second arm, and wherein the first arm length is less than the second arm length and the ground connection of the parasitic element is located closer to the first arm than the second arm.

2. The antenna of claim 1, wherein the antenna feed connects to the first distal end at a feed point of the excitation element.

3. The antenna of claim 2, wherein the third gap separation distance is between 0.1 and 1 mm.

4. The antenna of claim 1, wherein a third gap including a third gap separation distance is formed between the parasitic element and the feed line.

5. The antenna of claim 1, wherein the first arm length and the second arm length are substantially perpendicular to the feed line, and the first direction and the second direction are substantially opposite directions.

6. The antenna of claim 5, wherein the parasitic element length includes a first portion, a second portion, a third portion, a fourth portion, a fifth portion and a sixth portion, and the first portion is substantially parallel to the feed line, the second portion is substantially parallel to the first arm and the sixth portion is substantially parallel to the second arm.

7. The antenna of claim 6, wherein the third portion is substantially perpendicular to the second portion, the fourth portion is substantially perpendicular to the third portion and the fifth portion is substantially perpendicular to both the fourth portion and the sixth portion.

8. The antenna of claim 7, wherein the fourth portion includes a plurality of first and second sections, and the first sections are arranged along a first axis spanning between the third portion and the fifth portion and the second sections are arranged along a second axis spanning between the third portion and the fifth portion.

9. The antenna of claim 8, wherein the first axis and the second axis are parallel to each other.

10. The antenna of claim 7, wherein a thickness of the third portion of the parasitic element is different than a thickness of the fourth portion of the parasitic element.

11. The antenna of claim 1, wherein the first gap separation distance is between 0.1 and 1 mm.

12. The antenna of claim 1, wherein the second gap separation distance is between 0.1 and 1 mm.

13. The antenna of claim 1, wherein the parasitic element length is approximately between 78 and 106 millimeters, the first arm length is approximately between 25 and 30 millimeters, and the second arm length is approximately between 34 and 44 millimeters.

14. The antenna of claim 1, wherein the parasitic element is substantially coextensive with an entirety of the first arm length.

15. The antenna of claim 14, wherein the parasitic element is coextensive with less than half of the second arm length.

16. The antenna of claim 1, wherein the parasitic element length comprises a plurality of portions and at least one portion of the parasitic element length is thicker than other portions of the plurality of portions of the parasitic element length.

17. An electronic device having a broadband antenna and capable of wireless transmissions comprising:

a wireless signal module; and an antenna electrically connected to the wireless signal module, the antenna comprising:

an excitation element configured for coupling to an antenna feed carrying an excitation signal produced by a signal source; and a parasitic element including a ground connection and a parasitic element length, wherein the excitation element includes:

a feed line with a first distal end and a second distal end separated by a feed line length;

a first arm including a first arm length, wherein the first arm length extends from the second distal end in a first direction from the feed line; and a second arm including a second arm length, wherein the second arm length extends from the second distal end in a second direction from the feed line; and wherein the parasitic element length is at least partially coextensive with the excitation element such that a first gap including a first gap separation distance is formed between the parasitic element and the first arm and a second gap including a second gap separation distance is formed between the parasitic element and the second arm, and wherein the first arm length is less than the second arm length and the ground connection of the parasitic element is located closer to the first arm than the second arm.

18. The electronic device of claim 17, wherein the antenna feed connects to the first distal end at a feed point of the excitation element.

19. The electronic device of claim 17, wherein a third gap including a third gap separation distance is formed between the parasitic element and the feed line.

20. The electronic device of claim 17, wherein the first arm length and the second arm length are substantially perpendicular to the feed line, and the first direction and the second direction are substantially opposite directions.

21. The electronic device of claim 20, wherein the parasitic element length includes a first portion, a second portion, a third portion, a fourth portion, a fifth portion and a sixth portion, and the first portion is substantially parallel to the feed line, the second portion is substantially parallel to the first arm and the sixth portion is substantially parallel to the second arm.

22. The electronic device of claim 21, wherein the third portion is substantially perpendicular to the second portion, the fourth portion is substantially perpendicular to the third portion and the fifth portion is substantially perpendicular to both the fourth portion and the sixth portion.

23. A broadband antenna, comprising:

an excitation element configured for coupling to an antenna feed carrying an excitation signal produced by a signal source; and a parasitic element including a parasitic element length, wherein the excitation element includes:

a feed line with a first distal end and a second distal end separated by an excitation element length;

a first arm including a first arm length, wherein the first arm length extends from the second distal end in a first direction from the excitation element length;

a second arm including a first end and a second end with a second arm length spanning the distance between the first end and the second end, the first end of the second arm is attached to the second distal end of the excitation element, wherein the second arm length extends from the second distal end in a second direction from the excitation element length; and a second arm extension connected to the second end of the second arm, wherein the second arm extension includes a second arm extension length that extends perpendicular to the second arm length, and wherein the parasitic element length is at least partially coextensive with the excitation element, and wherein the first direction is opposite the second direction.

24. The broadband antenna of claim 23, wherein a first gap including a first gap separation distance is formed between the parasitic element and the first arm and a second gap including a second gap separation distance is formed between the parasitic element and the second arm extension.

25. The broadband antenna of claim 23, wherein the parasitic element is substantially coextensive only with the first arm length and the second arm extension length.

* * * * *